US005570485A

United States Patent [19]

Kurlander et al.

[11] Patent Number: 5,570,485

[45] Date of Patent: Nov. 5, 1996

[54] BED ASSEMBLY

[75] Inventors: Norman V. Kurlander, East Amherst; Gregory A. Fry, Lockport; Dennis J. Pomietlasz, Barker, all of N.Y.

[73] Assignee: NK Medical Products, Inc., Buffalo, N.Y.

[21] Appl. No.: 571,245

[22] Filed: Dec. 12, 1995

[51] Int. Cl.[6] ..... A47D 7/01; A61G 7/00

[52] U.S. Cl. ..... 5/617; 5/181; 5/424

[58] Field of Search ..... 5/613, 617, 181, 5/185, 424

[56] References Cited

U.S. PATENT DOCUMENTS

| | | | |
|---|---|---|---|
| 185,373 | 12/1876 | Wetmore | 5/617 |
| 186,694 | 1/1877 | Spanner | 5/617 |
| 256,176 | 4/1882 | Türk | 5/617 |
| 873,095 | 12/1907 | Rynn | 5/617 |
| 1,102,147 | 6/1914 | Foster | 5/617 X |
| 1,172,165 | 2/1916 | Owens | 5/617 |
| 2,062,056 | 11/1936 | Herod | 5/617 |
| 3,402,400 | 9/1968 | Hutt | 5/617 X |
| 3,693,200 | 9/1972 | Stafford | 5/617 |
| 4,406,027 | 9/1983 | Bourda | 5/181 X |
| 4,633,539 | 1/1987 | Morrison | 5/617 |
| 4,979,246 | 12/1990 | Godin et al. | 5/100 |

FOREIGN PATENT DOCUMENTS

| | | | |
|---|---|---|---|
| 66432 | 7/1891 | Germany | 5/617 |
| 352530 | 4/1922 | Germany | 5/617 |
| 623640 | 5/1949 | United Kingdom | 5/613 |
| 1073683 | 6/1967 | United Kingdom | 5/617 |
| 2124896 | 2/1984 | United Kingdom | 5/617 |

*Primary Examiner*—Michael F. Trettel
*Attorney, Agent, or Firm*—John C. Thompson

[57] ABSTRACT

A bed assembly (10) having a generally rectangular frame (22) and a mattress support (62, 64, 66, 68), the mattress support including a hinged head section (14) movable between raised and lowered positions, and an extender (76) supported by the hinged head section for extensible and retractable movement, the extender bridging the space between a headboard assembly (18) and the hinged head section when the hinged head section is in a raised position. An extender operating assembly (112) is provided for causing the extender to be extended towards the headboard assembly when the hinged head section is raised and for causing the extender to retract when the hinged head section is lowered. The extender operating assembly includes a sheave assembly preferably in the form of a pulley block (114) carried by the hinged head section, and a cord (116) having spaced apart ends and an intermediate section, the intermediate section (116.1) of the cord passing over the pulley block, one end (116.2) of the cord being secured to the frame, and the other end 116.3) being secured to the extender, the pulley block and cord being so arranged so that as the hinged head section is raised the extender will be caused to be extended. The extender operating means also includes a retractor in the form of a spring (122) to cause the extender to be retracted when the hinged head section is lowered. The bed assembly is also provided with a pair of stops (104, 108) to limit the maximum desired raised position of the pivoted head section.

10 Claims, 5 Drawing Sheets

BED ASSEMBLY

TECHNICAL FIELD

The present invention relates generally to bed assemblies, and more particularly to a bed assembly of the type having a hinged mattress support section at one end which can be moved between a lowered position and a raised position wherein the hinged mattress support section is provided with an extender which is automatically extended when the hinged mattress support is raised to minimize the gap between the hinged mattress support section and an associated headboard or the like.

BACKGROUND OF THE INVENTION

Bed assemblies having hinged elevatable mattress support portions at one end are well known in the prior art and are frequently used in hospitals where long term bed rest is required. U.S. Pat. No. 256,176 discloses a bed assembly having a pivoted mattress support section at one end, the pivoted mattress support being provided with a slide supported by the hinged mattress support, which slide is used to close the space which remains between the pivoted mattress support and a headboard. In this patent it is necessary to lift the pivoted mattress support to its desired elevated position and then to then slide out the slide.

A more recently issued patent U.S. Pat. No. 4,979,246 discloses a crib having a hinged mattress support section at one end, which hinged mattress support may be cranked between a lowered position and a raised position. A telescopic member is carried by the hinged mattress support portion and the end of the telescopic portion slidable engages rails of a headboard assembly so that when the hinged mattress support portion is moved to an elevated position the slide assembly will be moved outwardly to insure that there is no gap between the headboard and the pivoted mattress support portion. In some situation it is desirable to lower the headboard to permit access from the head of the bed, and this is not possible with the design shown in U.S. Pat. No. 4,979,246 except when the pivoted mattress support portion is in its fully lowered position.

OBJECTS AND SUMMARY OF THE INVENTION

It is an object of the present invention to provide a bed assembly having a mattress support assembly including a hinged mattress support section, which support carries an extender to insure that there is not a large gap between a headboard and the hinged mattress support section when it is in an elevated position, the extender being automatically extended by a mechanism supported solely by the mattress support assembly.

More particularly, it is an object of the present invention to provide a bed assembly having a mattress support assembly including a hinged head section which is movable between raised and lowered positions, an extender supported solely by the hinged head section for extensible and retractable movement, the extender bridging the space between a headboard and the hinged head section when the hinged head section is in its raised position, and extender operating means carried solely by the mattress support assembly for extending the extender when the hinged head section is moved towards its raised position, and for retracting the extender when the hinged head section is moved towards its lowered position.

The foregoing objects are achieved by providing a cord and sheave arrangement, the sheave being carried by the hinged head section, and the cord passing over the sheave means and being connected at one end to the mattress support assembly and at the other end to the extended in such a manner to cause the extender to be extended when the hinged head section is moved to its raised position. In order to retract the extender when the hinged head section when the hinged head section is moved towards it lower position a spring or the like is provided which is coupled between the extender and the hinged head section to insure that the extender will be retracted as the hinged head section is moved towards its lowered position.

The foregoing objects and other objects and advantages of this invention will become more apparent after a consideration of the following detailed description taken in conjunction with the accompanying drawings in which a preferred form of this invention is illustrated.

DETAILED DESCRIPTION

Figure 1:
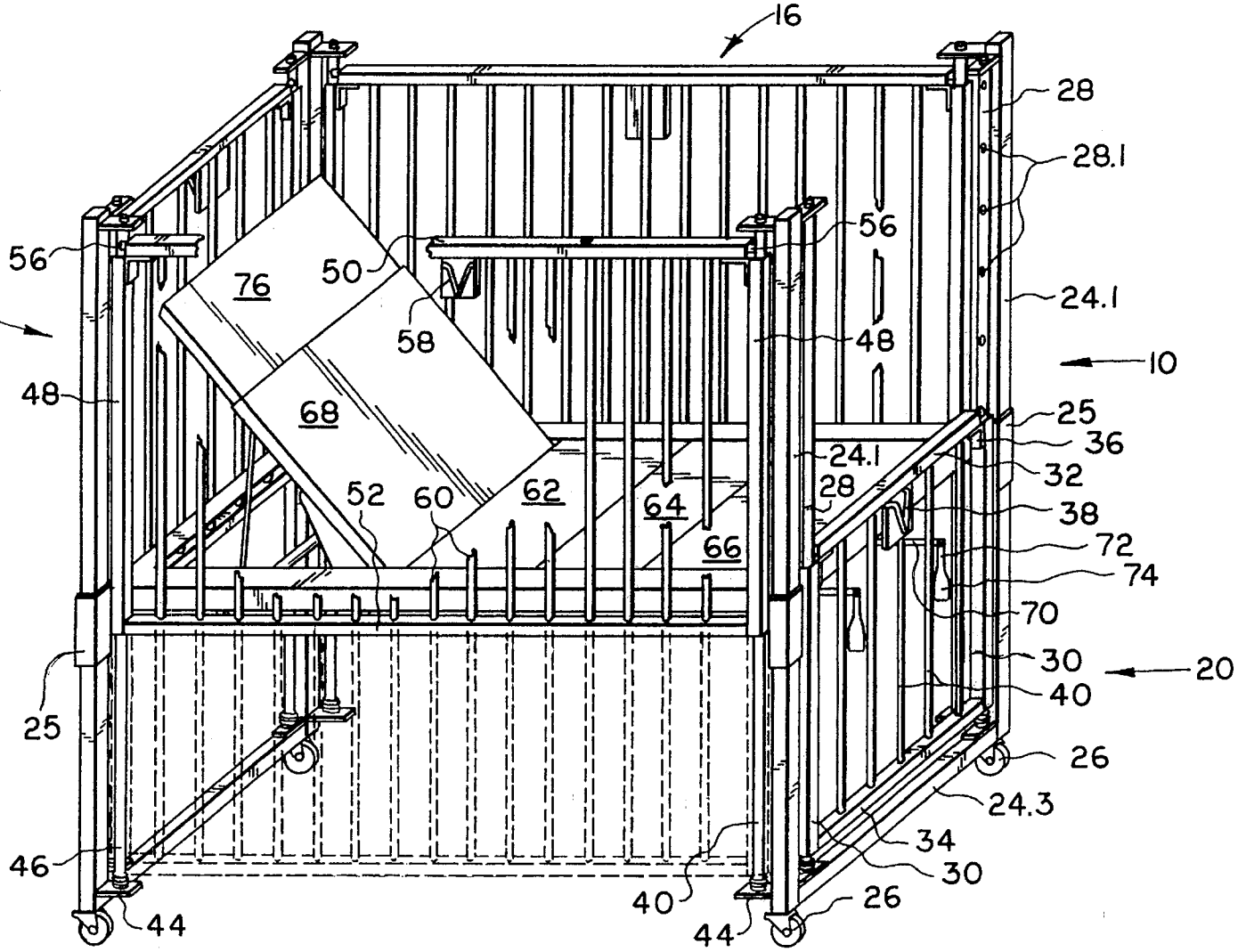
FIG. 1 is a view of a bed assembly incorporating the principles of the present invention, parts being broken away for the purposes of clarity, the bed assembly having a mattress support assembly including a frame and a mattress support, which support has a hinged head section moveable between raised and lowered positions.

With reference initially to FIG. 1, the bed assembly of this invention is indicated generally at 10. The bed assembly is shown in the form of a hospital crib having a mattress support assembly indicated generally at 12 in FIG. 8, which support assembly has a hinged head section indicated generally at 14. The hinged head section is moveable between raised and lowered positions and is shown in its raised position in FIGS. 1, 6, and 8. The crib is provided with side gate assemblies indicated generally at 16, a headboard assembly indicated generally at 18, and a footboard assembly indicated generally at 20. In the illustrated crib all of the assemblies 16, 18, and 20 are movable between raised and lowered positions to facilitate access to the infant from any side of the crib, and in FIG. 1 the side gate assemblies and headboard assembly 18 are shown in their raised positions, one of the side rails also being shown in a dotted-line lower position, and the footboard assembly 20 is shown in its lowered position.

Figure 8:
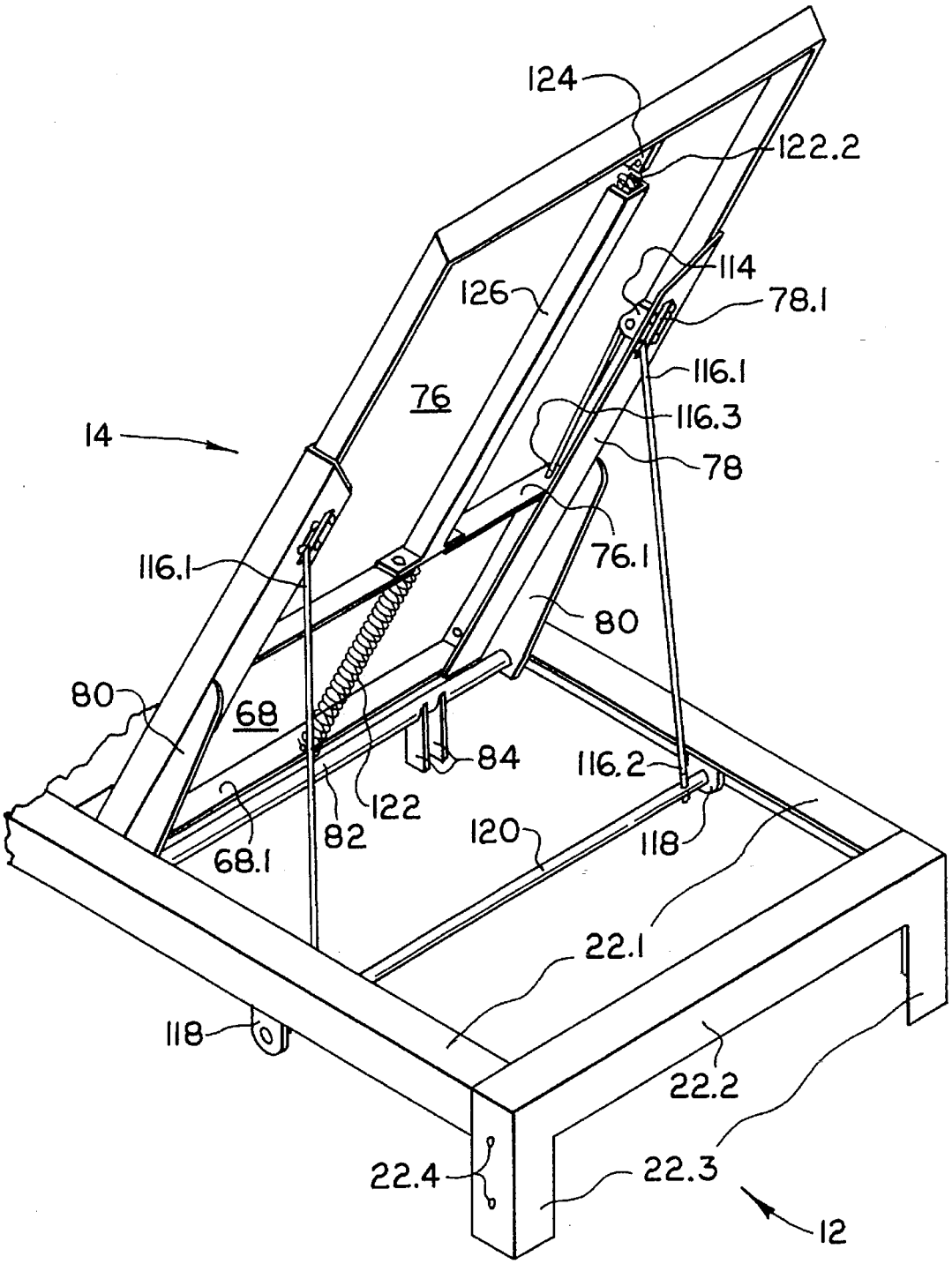
FIG. 8 is an isometric view of a portion of the mattress support assembly showing the hinged head section in its fully raised position.

The mattress support assembly includes a generally rectangular frame having horizontal side rails 22.1 and end rails 22.2, the side and end rails being welded or otherwise rigidly secured to each other as shown in FIG. 8. Right and left hand end brackets 22.3 extend downwardly from each of the end rails 22.1, the brackets being provided with suitable apertures 22.4. End frame assemblies are bolted or otherwise secured to the brackets 22.3, each of the end frame assemblies including right and left legs 24.1, top brackets 24.2 supported by the upper end of each of the legs 24.1, and a bottom frame member 24.3, the frame member and legs being rigidly interconnected with each other by welding or the like. A saddle 15 is rigidly secured by welding or the like to an intermediate portion of each of the legs, each saddle being provided with an extension (not shown) which can be bolted to the bracket 22.3. Castors 26 are mounted at the bottom ends of the legs, at least two of the castors being of the locking type.

Figure 1A:
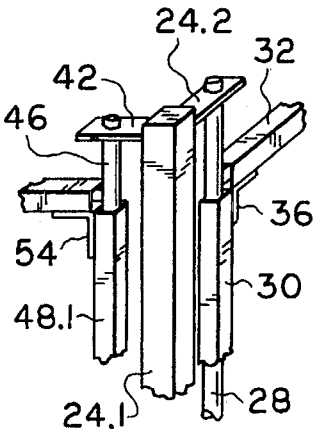
FIG. 1A is an enlarged perspective view of a corner of the bed assembly shown in FIG. 1, a footboard assembly being shown in its raised position.

The headboard and footboard assemblies 18 and 20 are carried by the end frame assemblies. To this end, apertured tubes 28 are supported by the top brackets 24.2 and the bottom frame member 24.3, the apertured tubes being spaced slightly inwardly of the legs 24.1. The headboard or footboard is provided with rectangular vertically extending tubes 30 which are positioned about the apertured tubes, the headboard or footboard also including upper and lower horizontally extending rectangular tubes 32, 34. The lower tube 34 is welded within the tubes 30 as shown, and the upper tube 32 is secured to the upper horizontal surface of an L-shaped bracket 36 which extends inwardly from the top of the tubes 30. Mounted within the upper tube 32 are a pair of horizontally shiftable pins (not shown) which, when in their outer spring biased position, are adapted to engage selected apertures 28.1 in the associated apertured tube. The pins can be retracted by the operation of adjacent handles 38. Thus, as shown in FIG. 1, the footboard assembly can be moved from its lowered position, as shown, by squeezing the handles together, and then by raising the footboard assembly to its desired raised position at which time the handles are released and the pins are spring biased into a suitable aperture 28.1, a portion of the footboard being shown in its raised position in FIG. 1A. In the illustrated embodiment the footboard and headboard are formed of vertically extending dowel rods 40 which extend between the upper and lower horizontally extending rectangular tubes 32, 34, respectively.

The side gates are also secured to the legs. To this end, upper and lower brackets 42, 44, respectively, are secured to the right and left hand legs 24.1, the brackets receiving vertically extending apertured tubes 46 which are virtually identical to the tubes 28. The side gates each include rectangular vertically extending tubes 48 disposed about the apertured tubes 46, upper and lower horizontally extending rectangular tubes 50, 52, the upper tube 50 being secured to the vertically extending tubes 48 via brackets 54. Mounted within the upper horizontally extending rectangular tube are head end and foot end shiftable pins 56 which may be received within suitable apertures within the apertured tubes 46, the pins being operated by handles 58. The side gates are completed by dowel rods 60 which extend between the upper and lower tubes 50, 52.

The mattress support assembly 12 includes, in addition to the generally rectangular frame 22, a mattress support including a divider panel 62, first and second foot lift panels 64 and 66, and a head panel 68 (which is part of the hinged head section 14). The divider panel 62 is located flush with the top of the generally rectangular frame 22 and is rigidly secured to the side rails 22.1. The first foot lift panel 64 is hinged to the frame 22 adjacent the divider panel 62 and may be swung from the lowered position illustrated to a raised position by operation of a foot lift assembly means which includes a threaded rod 70, a rotatable crank 72, and a pivoted handle 74 as is conventional. The second foot lift panel 66 is hinged to the first foot lift panel and is also operated in a conventional manner.

In accordance with this invention, an extender 76 is provided, which extender substantially eliminates the open area between the headboard assembly 18 and the hinged head section remote from the panel 62. The extender stores within the hinged head section when they are in their lowered position, and telescopes outwardly from the hinged head section 14 as the hinged head section is elevated, the extension of the extender being controlled so that there is not an unsafe distance between the extender and the headboard assembly.

Figures 6, 7:
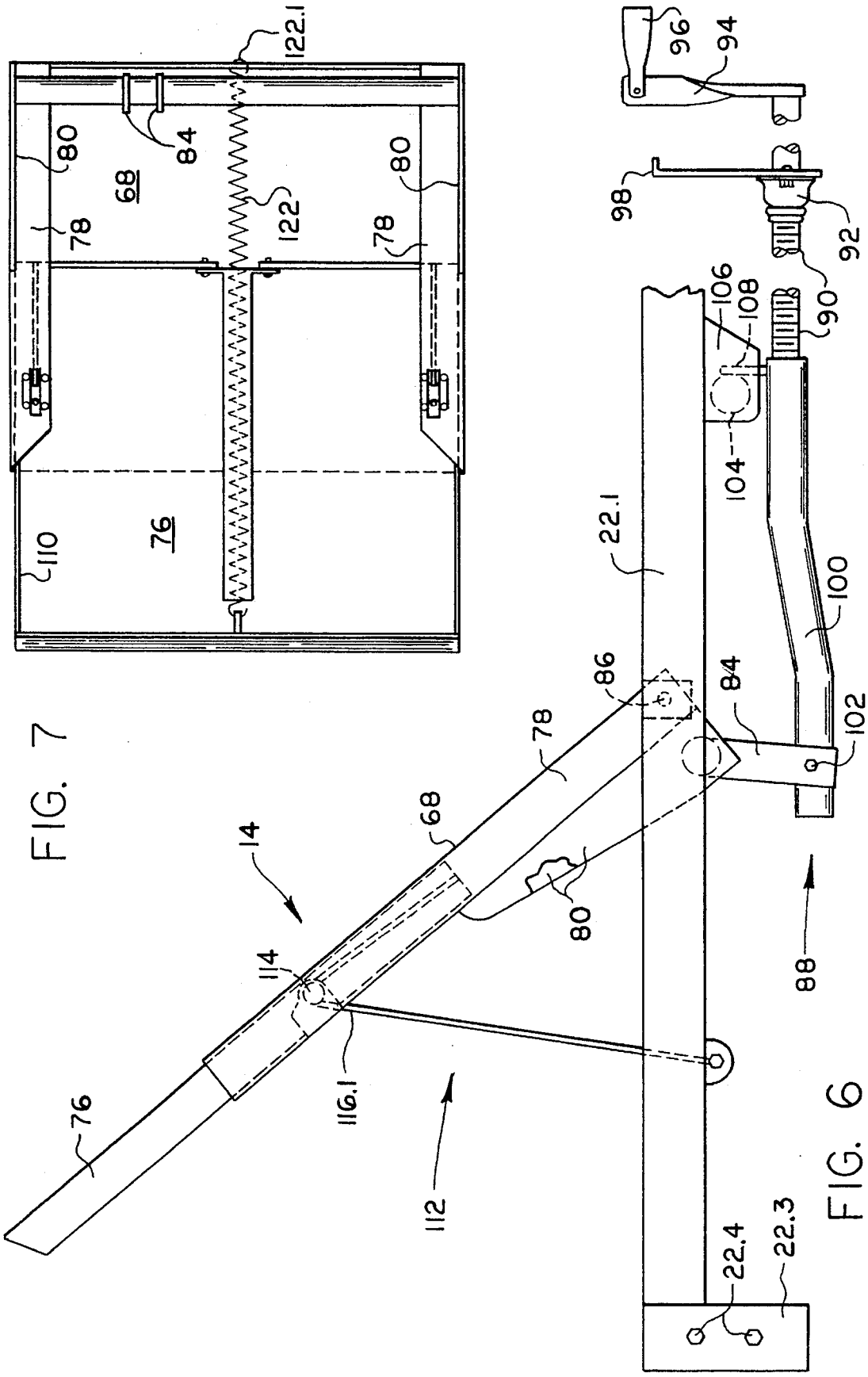
FIG. 6 is a view similar to FIGS. 2 and 4, this view showing the hinged head section in its fully raised position.
FIG. 7 is a view similar to FIGS. 3 and 5 showing the hinged head section in its raised position.

With reference now to FIGS. 6 through 8, it can be seen that the hinged head section 14 includes, in addition to the head panel 68, C-shaped side channels 78 which may be formed integrally with the head panel 68. Extending downwardly from the channels 78 are a pair of brackets 80 which support a head panel tube 82. Secured to the head panel tube 82 are a pair of bell cranks 84. The hinged head section 14 is pivotally secured to the side rails 22.1 by means of pivot pin assemblies 86, one of which is shown in FIG.6.

Figure 2:
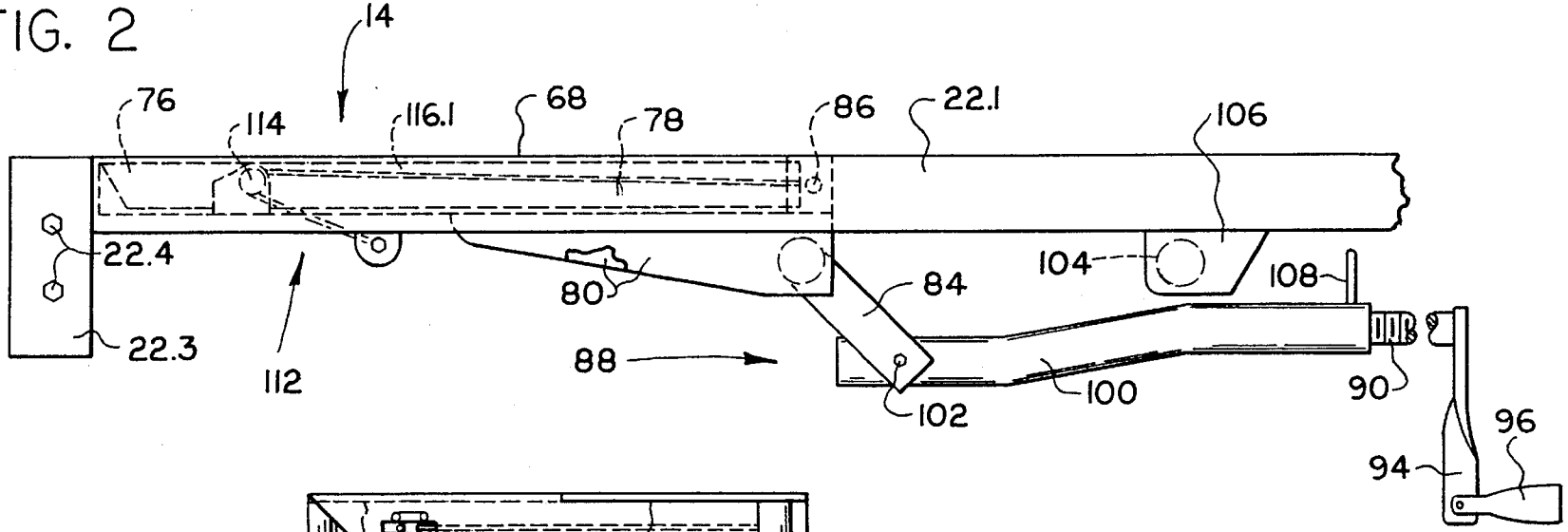
FIG. 2 is a side view of the hinged head section shown in FIG. 1, the hinged head section being shown in its lowered position.
Figure 3:
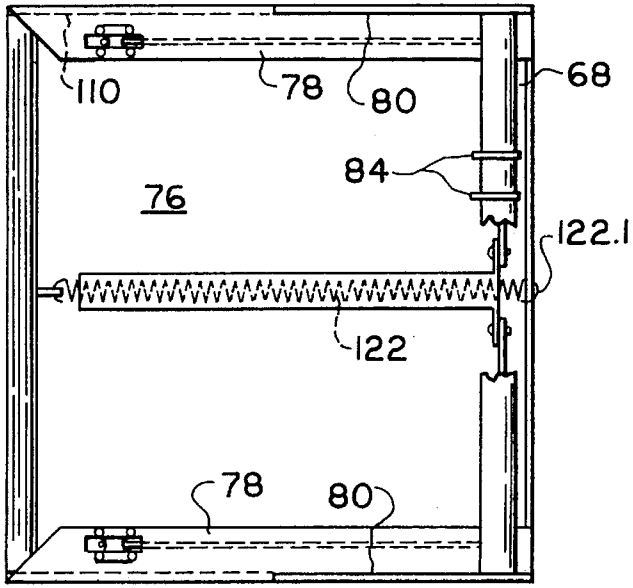
FIG. 3 is a bottom plan view of the hinged head section shown in FIG. 2.
Figure 5:
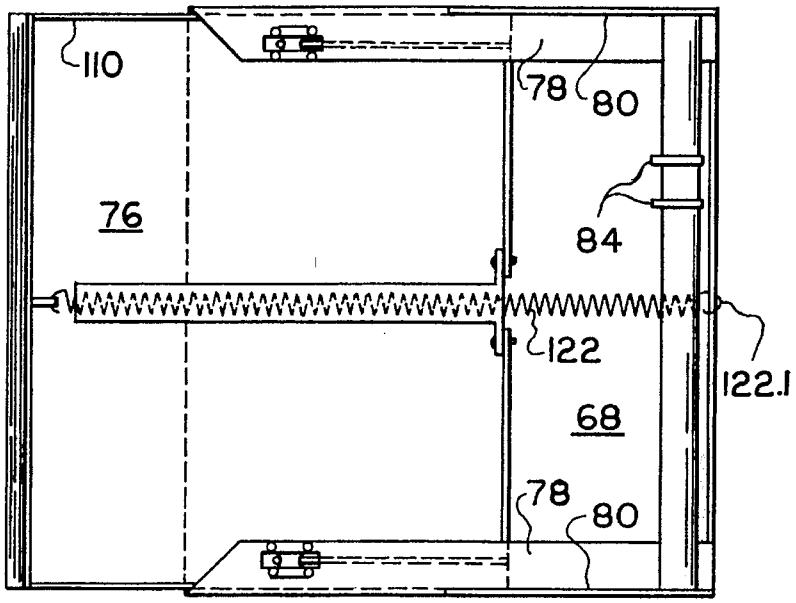
FIG. 5 is a bottom plan view of the hinged head section shown in FIG. 4.
Figure 4:
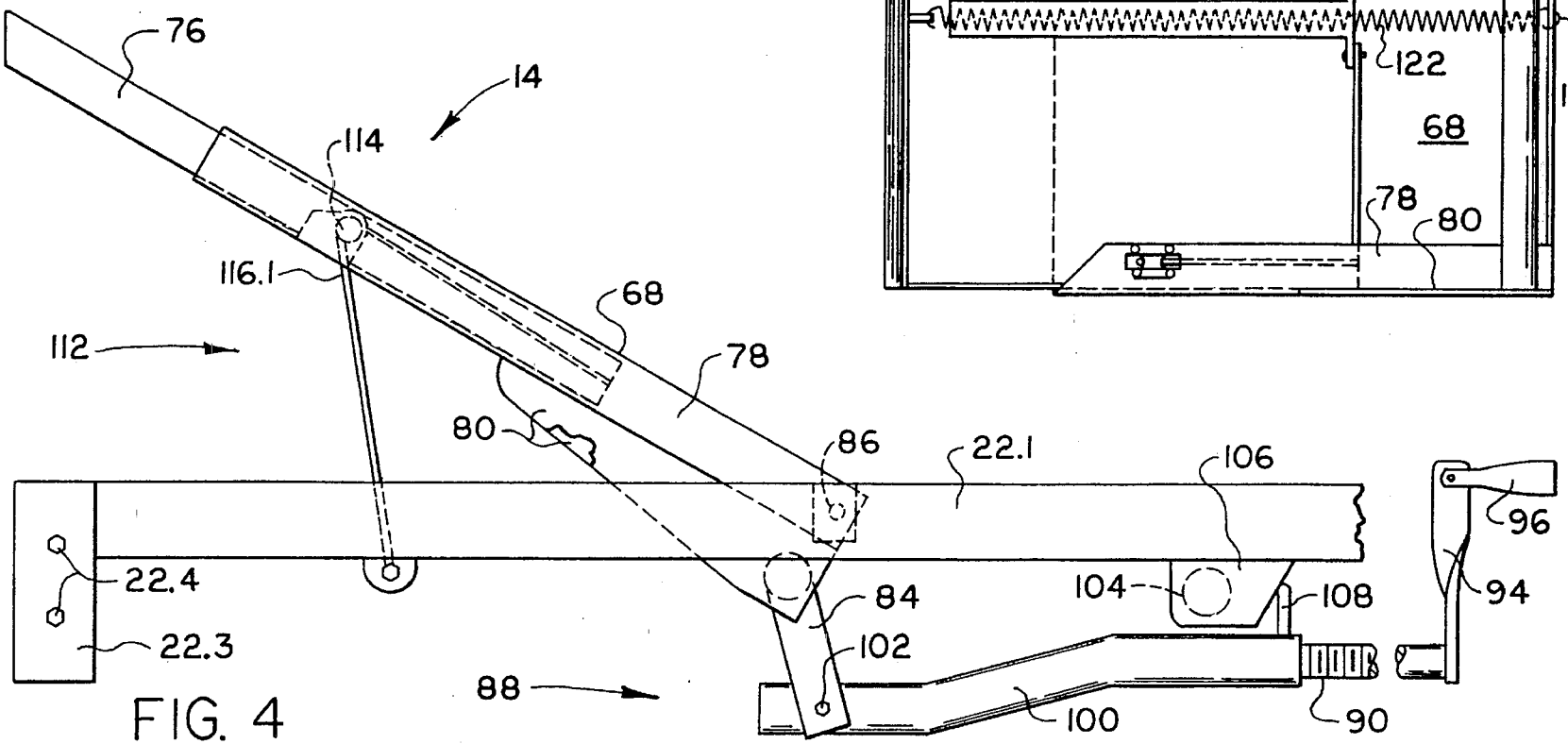
FIG. 4 is a view similar to FIG. 2 showing the hinged head section in a partially raised position.

The hinged head section 14 can be moved from it lowered position shown in FIG. 2 to its fully extended position shown in FIG. 6 by operation of head lift assembly means indicated generally at 88. The head lift assembly means includes a threaded crank mechanism 90 which is rotatably journaled within a bearing block 92, the threaded crank mechanism including a crank 94 and a pivoted handle 96. As can be seen from FIG. 6, the bearing block 92 is supported by an L-shaped panel 98 which is in turn supported by the side rails 22.1 and the end rail 22.2 at the footboard side of the mattress support assembly. The head lift assembly means 88 further includes an extensible and retractable tubular member 100 which is pivotally secured to the bell cranks 84 by means of a pivot pin assembly 102 which may be in the form of a suitable nut, bolt, and washers. The tubular member 100 is also provided with an internal nut (not shown) into which the threaded portion of the threaded crank mechanism 90 is received. It can thus be seen that as the threaded crank mechanism is rotated by operation of the handle 96 that the extensible and retractable member will be moved towards and away from the bearing 92 causing the hinged head section to be moved between its lowered position and fully raised position. To limit upward movement of the hinged head section 14 first and second stops are provided, the first stop being mounted on the frame, the second stop being mounted on the tubular member 100. The first stop consists of a tube 104 carried by depending brackets 106 secured to the spaced apart side rails 22.1. The second stop consists of an upwardly extending pin 108 carried by the tubular member 100. As can be seen from FIG. 6, when the pin 108 contacts the tube 104 further upward movement of the hinged head section 14 will not be permitted.

The extender 76 has sides 110 which are slidably supported within the C-shaped side channels 78. If desired guide strips (not illustrated) may be mounted within the channels 78 to facilitate the movement of the extender 76 between its retracted position and its extended position.

Extender operating means, indicated generally at 112, are provided for causing the extender to extend towards the headboard assembly 18 when the hinged head section 14 is raised and for causing the extender 76 to retract when the hinged head section is lowered. To this end, the extender operating means includes a pair of sheave means, each being in the form of a pulley block 114, and a pair of cords made of any suitable material. An intermediate portion 116.1 of each of the cords passes over the associated sheave means. While pulley blocks are shown in the drawings, it should be appreciated that other devices may be employed instead of each of the pulley blocks, such as a lubricated grooved curved surface, a plurality of grooved rollers, or a grooved cam. Thus, the term sheave means is intended to cover all of these devices. One end 116.2 of each of the cords is secured to the frame. To this end, as can best be seen from FIG. 8, a pair brackets 118, which are welded to the side rails 22.1, carry a rod 120, the rod in turn being provided with suitable apertures for receiving the ends 116.2 of the cords, the end of each of the cords which pass through the apertures in the rod 120 having an enlargement, such as a knot, so that it cannot be drawn through the aperture. The other end 116.3 of each of the cords passes through a suitable aperture in flange 76.1 and is secured in the same manner as the end 116.2 is secured. As can be seen, each of the pulley blocks 114 is mounted on a C-shaped side channel of the hinged head section, and to this end a slot 78.1 is provide within each channel for the reception of the intermediate portion 116.1 of the associated cord.

The extender operating means 112 also includes retractor means in the form of a tension spring 122. One end 122.1 of the tension spring is secured to a flange 68.1 of the head panel 68 and the other end 122.2 is secured to a bracket 124 which is in turn secured to the extender 76. An intermediate portion 122.3 of the spring passes through a longitudinally extending centrally located U-shaped channel 126 which is supported by the underside of the extender panel 76. While a spring has been illustrated as the retractor, it should be appreciated that other devices could perform the same function, such as hydraulic, pneumatic piston or strut.

In operation, to raise the hinged head section and to cause the extender to be extended, it is only necessary to rotate the crank 94 in the appropriate direction to move the tubular member towards the headboard which will in turn cause the hinged head section to be moved upwardly from the position shown in FIG. 2 towards the position shown in FIG. 6. As upward movement is taking place, the cord 116 will cause the extender 76 to move outwardly of the head panel 68 until it achieves its fully extended position shown in FIG. 6. To retract the extender, it is only necessary to rotate the crank 94 in the opposite direction which will cause the hinged head section to be lowered. As the panel 68 is lowered, the spring 122 will cause the extender to become retracted.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims. While reference is made in the claims to a headboard and hinged head section, this has been done for purposes of clarity. It should be obvious that the present invention may also be applied to an elevatable foot section, and if so applied such a design would be an equivalent of what is claimed.

What is claimed is:

1. A bed assembly comprising:

a mattress support assembly including a generally rectangular frame, and a mattress support carried by the frame, the mattress support including a hinged head section movable between raised and lowered positions;

a headboard assembly interconnected with the generally rectangular frame;

an extender supported by the hinged head section for extensible and retractable movement, the extender bridging the space between the headboard assembly and the hinged head section when the hinged head section is in a raised position; and extender operating means for causing the extender to extend towards the headboard assembly when the hinged head section is raised and for causing the extender to retract when the hinged head section is lowered, the extender operating means being supported solely by the mattress support assembly.

2. A bed assembly comprising:

a mattress support assembly including a generally rectangular frame, and a mattress support carried by the frame, the mattress support including a hinged head section movable between raised and lowered positions;

a headboard assembly interconnected with the frame;

an extender supported by the hinged head section for extensible and retractable movement, the extender bridging the space between the headboard assembly and the hinged head section when the hinged head section is in a raised position;

head lift assembly means for raising and lowering the hinged head section; and extender operating means for causing the extender to extend towards the headboard assembly when the hinged head section is raised and for causing the extender to retract when the hinged head section is lowered, the extender operating means being characterized by sheave means carried by the hinged head section, a cord having spaced apart ends and an intermediate section, the intermediate section of the cord passing over the sheave means, one end of the cord being secured to the frame, and the other end being secured to the extender, the sheave means and cord being arranged so that as the hinged head section is raised the extender will be caused to be extended, and retractor means to cause the extender to be retracted when the hinged head section is lowered.

3. The bed assembly as set forth in claim 2 wherein the sheave means is a pulley.

4. The bed assembly as set forth in claim 2 wherein the retractor means is a tension spring, one end of which is connected to the hinged head section, and the other end of the spring being connected to the extender.

5. The bed assembly as set forth in claim 4 wherein the extender is provided with a longitudinally extending centrally located U-shaped channel, the tension spring being partially disposed within the U-shaped channel.

6. The bed assembly as set forth in claim 2 wherein the hinged head section includes a bell crank rigidly connected thereto, and wherein the head lift assembly means includes a threaded crank mechanism including an extensible and retractable tubular member pinned to the bell crank so that as the tubular member is either extended or retracted the hinged head section will be either raised or lowered, respectively.

7. The bed assembly as set forth in claim 6 wherein the frame is provided with a first stop, and wherein the head lift assembly is provided with a second stop which engages the first stop when the hinged head section has achieved its maximum desired raised position.

8. The bed assembly as set forth in claim 7 wherein the second stop is mounted on the extensible and retractable member.

9. The bed assembly as set forth in claim 2 wherein the hinged head section includes C-shaped side channels, and wherein the extender has sides which are slidably support within the C-shaped channels.

10. The bed assembly as set forth in claim 9 wherein each of the channels is provided with a slot, wherein the extender means includes a pair of cords, and intermediate portion of each of the cords passing through the slot, and wherein the sheave means is a pair of pulleys, one pulley being disposed adjacent each of the slots.

* * * * *